US010205276B2

(12) United States Patent
Shinmi

(10) Patent No.: US 10,205,276 B2
(45) Date of Patent: Feb. 12, 2019

(54) LEVER-TYPE CONNECTOR

(71) Applicant: Yazaki Corporation, Minato-ku, Tokyo (JP)

(72) Inventor: Yoshifumi Shinmi, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/894,353

(22) Filed: Feb. 12, 2018

(65) Prior Publication Data

US 2018/0248312 A1 Aug. 30, 2018

(30) Foreign Application Priority Data

Feb. 28, 2017 (JP) ..... 2017-036758

(51) Int. Cl.
*H01R 13/62* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62933; H01R 13/62938; H01R 13/62944; H01R 13/6295; H01R 13/62955; H01R 13/62961; H01R 13/62972; H01R 13/62977
See application file for complete search history.

(56) References Cited

U.S. PATENT DOCUMENTS

| | | | | |
|---|---|---|---|---|
| 7,364,453 | B2 | 4/2008 | Matsuura et al. | |
| 9,831,602 | B1 * | 11/2017 | Kanda | H01R 13/62977 |
| 2007/0298637 | A1 | 12/2007 | Matsuura et al. | |
| 2014/0099807 | A1 * | 4/2014 | Hotea | H01R 13/44 439/131 |
| 2014/0349504 | A1 * | 11/2014 | Kuroda | H01R 13/62955 439/310 |
| 2016/0056574 | A1 * | 2/2016 | Shimizu | H01R 13/62938 439/160 |
| 2016/0190727 | A1 * | 6/2016 | Kataoka | H01R 13/62938 439/660 |
| 2016/0226187 | A1 * | 8/2016 | Sakamoto | H01R 13/64 |
| 2016/0254618 | A1 * | 9/2016 | Ludwig | H01R 13/62938 439/372 |
| 2016/0336686 | A1 * | 11/2016 | Obata | H01R 13/62938 |
| 2017/0125942 | A1 * | 5/2017 | Guillanton | H01R 13/62955 |

(Continued)

FOREIGN PATENT DOCUMENTS

| | | | |
|---|---|---|---|
| JP | 2008-034336 | A | 2/2008 |
| JP | 2009-117059 | A | 5/2009 |
| JP | 2012-238472 | A | 12/2012 |

*Primary Examiner* — Ross N Gushi
(74) *Attorney, Agent, or Firm* — Banner & Witcoff, Ltd.

(57) ABSTRACT

A lever-type connector includes a first housing and a second housing which are capable of being fitted to each other and a lever mounted on the second housing and which is movable from a fitting start position to a fitting completion position. The first housing includes a pressing part. The second housing includes a housing side locking part and a guide inclined surface which is adjacent to the housing side locking part. The lever includes a lever side locking part. The lever side locking part is elastically deformable in a first direction and locked to the housing side locking part when the lever is located on the fitting start position.

3 Claims, 8 Drawing Sheets

(56) References Cited

U.S. PATENT DOCUMENTS

| | | | | |
|---|---|---|---|---|
| 2017/0279222 | A1* | 9/2017 | Kayano | H01R 13/62933 |
| 2017/0346223 | A1* | 11/2017 | Chikusa | H01R 13/428 |
| 2017/0346225 | A1* | 11/2017 | Kanda | H01R 13/62955 |
| 2017/0373433 | A1* | 12/2017 | Matsumoto | H01R 13/533 |
| 2018/0040979 | A1* | 2/2018 | Ishida | H01R 13/5025 |
| 2018/0062312 | A1* | 3/2018 | Shindo | H01R 13/62938 |
| 2018/0069345 | A1* | 3/2018 | Shimizu | H01R 13/62938 |
| 2018/0069346 | A1* | 3/2018 | Shimizu | H01R 13/502 |
| 2018/0241152 | A1* | 8/2018 | Tanikawa | H01R 13/629 |
| 2018/0248310 | A1* | 8/2018 | Hirota | H01R 13/62966 |
| 2018/0248311 | A1* | 8/2018 | Shinmi | H01R 13/62938 |

* cited by examiner

LEVER-TYPE CONNECTOR

CROSS REFERENCE TO RELATED APPLICATIONS

This application claims priority from Japanese Patent Application No. 2017-036758 filed on Feb. 28, 2017, the entire contents of which are incorporated herein by reference.

BACKGROUND OF THE INVENTION

Field of the Invention

The invention relates to a lever-type connector which comprises a first housing and a second housing fittable to each other, and a lever mounted on the second lever.

Description of Related Art

Conventionally, there is proposed a lever-type connector comprising a lever which assists in the fitting of a male housing and a female housing.

For example, in one of conventional lever-type connectors, a lever is rotatably mounted on one housing and a projecting pin is provided in the other housing. And, in a state where the projecting pin is inserted into a cam hole formed in the lever, by rotating the lever from a fitting start position to a fitting completion position, both housings are drawn to each other and are fitted to each other.

[Patent Document 1] JP-A-2009-117059

[Patent Document 2] JP-A-2012-238472

[Patent Document 3] JP-A-2008-034336

According to a related art, a lever-type connector comprises a locking mechanism which locks a lever to a fitting start position (a temporary lock position) to prohibit the lever against further rotation (rotation toward a fitting completion position [final lock position]). Thus, when the lever is not in its original fitting state (for example, both housings are separated from each other), the lever can be held at the fitting start position to thereby prevent the lever against unintentional rotation and the like.

In the lever-type connector comprising such locking mechanism, from the viewpoint of improving the workability of the fitting, etc., it is desirable to improve an operation feeling just after the locking of the lever by the locking mechanism is removed and the lever is started to move from the fitting start position toward the fitting completion position.

SUMMARY

One or more embodiments provide a lever-type connector which can improve an operation feeling just after the locking of a lever is removed and the lever is started to move from a fitting start position toward a fitting completion position.

In an aspect (1), a lever-type connector includes a first housing and a second housing which are capable of being fitted to each other and a lever mounted on the second housing and which is movable from a fitting start position to a fitting completion position. The first housing includes a pressing part. The second housing includes a housing side locking part and a guide inclined surface which is adjacent to the housing side locking part. The lever includes a lever side locking part. The lever side locking part is elastically deformable in a first direction and locked to the housing side locking part when the lever is located on the fitting start position. The pressing part moves in a fitting direction together with the first housing and presses the lever side locking part in the first direction into elastic deformation so as to release locking between the lever side locking part and the housing side locking part. The guide inclined surface receives the lever side locking part when the lever side locking part is pressed by the pressing part and is unlocked from the housing side locking part, and the guide inclined surface has an inclination so as to move the lever toward the fitting completion position when the lever side locking part recovers elasticity and presses the guide inclined surface.

In an aspect (2), the lever side locking part includes a projecting section projecting so as to be point-contact or line-contact with the guide inclined surface.

In an aspect (3), the first housing includes a cam boss which moves together with the first housing in the fitting direction when the first housing and the second housing are fitted to each other. The lever includes a cam groove capable of receiving the cam boss. The lever moves from the fitting start position to the fitting completion position while moving the cam boss along the cam groove. The pressing part is formed in a vicinity of the cam boss. The lever side locking part is formed in a vicinity of an entrance part of the cam groove in which the cam boss enters.

According to the aspect (1), before the fitting is started, the lever side locking part is locked to the housing side locking part of the second housing. And, in the fitting, when the lever side locking part is pressed by the pressing part and the locking thereof is removed, the lever side locking part is quickly guided to the guide surface adjacent to the housing side locking part. And, when the lever side locking part recovers elasticity and presses the guide inclined surface, due to the reaction force thereof, the lever moves (rotates) toward the fitting completion position.

Thus, just after removal of the locking of the lever side locking part, there is provided an effect to assist the movement (rotation) of the lever by the guide inclined surface. This assist effect can improve an operation feeling just after the lever starts to move (rotate) from the fitting start position (temporary lock position) toward the fitting completion position (final lock position).

Therefore, the lever-type connector of this configuration can improve an operation feeling just after the locking of a lever is removed and the lever is started to move from a fitting start position toward a fitting completion position.

According to the aspect (2), the projecting section of the lever side locking part comes into contact with the guide inclined surface in point contact or in line contact. As a result, a frictional resistance force produced between them can be reduced, thereby enabling enhancement in the above-mentioned movement assist effect by the guide inclined surface.

According to the aspect (3), the pressing part is arranged in the vicinity of the cam boss and the lever side locking part is arranged in the vicinity of the entrance part of the cam groove. Thus, at the timing when the cam boss enters the entrance part of the cam groove (that is, the cam boss starts to come into contact with the cam groove), the locking of the lever side locking part is removed and the movement of the cam boss along the cam groove (that is, the movement of the lever) is started smoothly. This can improve the lever operation feeling further.

According to one or more embodiments, it is possible to provide a lever-type connector which can improve an operation feeling just after the locking of a lever is removed and the lever is started to move from a fitting start position toward a fitting completion position.

One or more embodiments has been described briefly heretofore. Further, when the mode for carrying out the invention to be described below is read through with reference to the accompanying drawings, the details of the invention will be clarified further.

DETAILED DESCRIPTION

Embodiment

Description is given below of a lever-type connector 1 according to an embodiment of the invention with reference to the drawings.

Figure 1A:
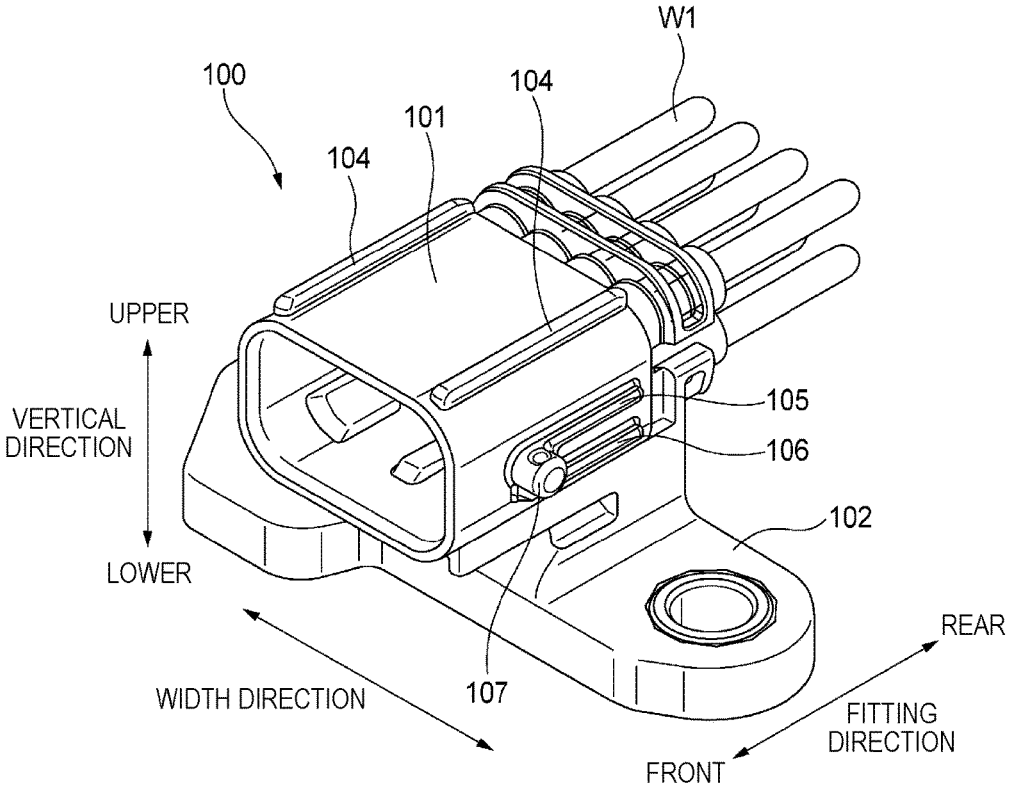
FIG. 1A is a perspective view of a male housing constituting a lever-type connector according to an embodiment of the invention, when viewed from front.
Figure 1B:
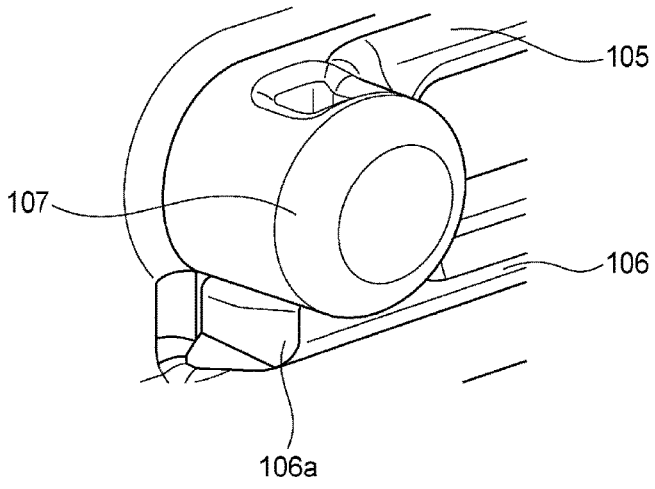
FIG. 1B is an enlarged perspective view of the periphery of a cam boss shown in FIG. 1A.
Figure 2A:
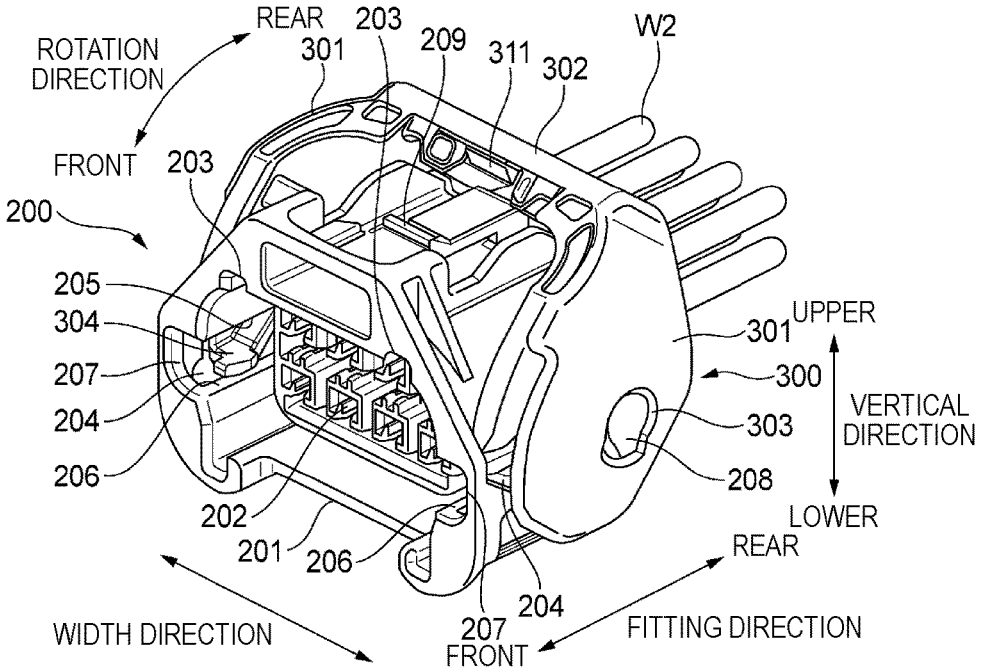
FIG. 2A is a perspective view of a female housing (with a lever mounted thereon) constituting the lever-type connector according to the embodiment of the invention, when viewed from front.
Figure 2B:
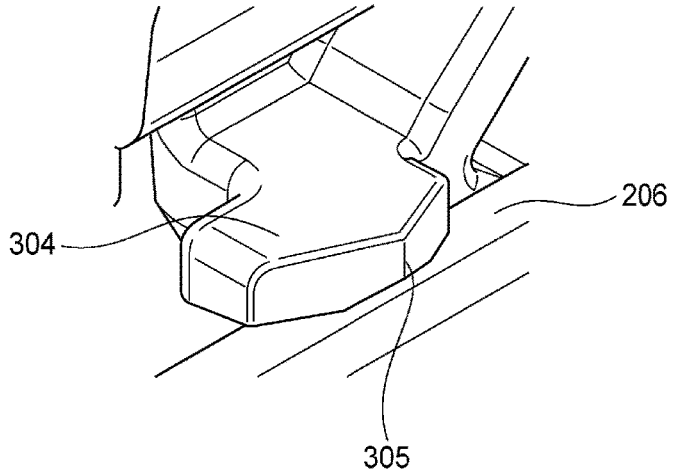
FIG. 2B is an enlarged perspective view of the periphery of a lever side locking part shown in FIG. 2A.

The lever-type connector 1 according to an embodiment of the invention includes a male housing 100 shown in FIGS. 1A and 1B, a female housing 200 shown in FIGS. 2A and 2B which is fitted to the male housing 100 so as to store therein the male housing 100 (the male housing 100 is inserted into the female housing 200), and a lever 300 shown in FIGS. 2A and 2B to be rotatably mounted on the female housing 200.

As shown in FIGS. 1A and 1B and FIGS. 2A and 2B, the following terms are defined here: that is, [fitting direction], [width direction], [vertical direction], [front], [rear], [upper], [lower] and the [rotation direction] of the lever 300. The [fitting direction], [width direction] and [vertical direction] are orthogonal to each other. Further, [the fitting time between the male housing 100 and female housing 200] is also called [the fitting time] simply. FIGS. 2A and 2B show a state where the lever 300 is in a temporary lock position (fitting start position), while the lever 300 rotates forward from the temporary lock position (fitting start position) and thus moves toward a final lock position (fitting completion position).

As shown in FIG. 1A, the male housing 100 is made of resin, and includes a square tubular main body peripheral wall part 101 long in the width direction and a stay part 102 extending in the width direction integrally from the lower end of the main body peripheral wall part 101. In the inside of the main body peripheral wall part 101, there are formed multiple storing chambers 103 (see FIG. 4A) which respectively extend along the fitting direction for storing therein multiple male terminals T1 (see FIG. 4A) respectively connected to the ends of multiple (in this embodiment, eight) electric wires W1.

In the vicinities of the two ends in the width direction of the upper surface of the main body peripheral wall part 101, there are formed a pair of upper surface ribs 104. The paired upper surface ribs 104 project in the upper direction and extend in the fitting direction in parallel to each other substantially over the whole areas of the main body peripheral wall part 101 in the fitting direction. In the upper and lower parts of the two side surfaces of the main body peripheral wall part 101, there are formed an upper rib 105 and a lower rib 106 which respectively project outward in the width direction and extend in the fitting direction in parallel to each other from the vicinity of the rear end of the main body peripheral wall part 101 up to a position existing slightly forward from the center in the fitting direction.

The main body peripheral wall part 101 includes, on the two side surfaces thereof, cam bosses 107 respectively. Each cam boss 107 is formed at a position between the front ends of the upper rib 105 and lower rib 106 and projects outward in the width direction more greatly than the upper rib 105 and lower rib 106. As shown in FIG. 1B, the shape of the section of the cam boss 107 (the shape of the section orthogonal to the projecting direction of the cam boss 107) is an elliptical shape the major diameter of which extends along the fitting direction (see FIGS. 4A and 4B and others).

As shown in FIG. 2A, the female housing 200 is made of resin and includes a square tubular main body peripheral wall part 201 long in the width direction. In the fitting time, the male housing 100 and female housing 200 are fitted to each other in such a manner that the inner peripheral surface of the main body peripheral wall part 201 and the outer peripheral surface of the main body peripheral wall part 101 of the male housing 100 are overlapped with each other (see FIG. 3 and FIGS. 4A and 4B as well). In the inside of the main body peripheral wall part 201, there are formed multiple terminal storing chambers 202 (see FIG. 4A) along the fitting direction respectively for storing therein multiple female terminals T2 (see FIG. 4A) respectively connected to the ends of multiple (in this embodiment, eight) electric wires W2.

The main body peripheral wall part 201 has a pair of upper surface grooves 203 in the vicinities of the width-direction two ends of the inside surface of the upper wall thereof. The paired upper surface grooves 203 are recessed in the upper direction and extend from the front end of the main body peripheral wall part 101 toward the rear side thereof in the fitting direction in parallel to each other. In the two side walls of the main body peripheral wall part 201, respectively, there are formed windows (penetration holes) 204 extending in the fitting direction. The upper edge surface 205 and lower edge surface 206 of each window 204 extend rearward from the front end of the main body peripheral wall part 101 in the fitting direction in parallel to each other. The main body peripheral wall part 201 includes, in the front ends of the inside surfaces of the two side walls thereof, side surface grooves 207 which respectively continue with the front ends of the upper edge surface 205 and lower edge surface 206 of the window 204 and are recessed outward in the width direction.

In the fitting time, the paired upper surface ribs 104 of the male housing 100 are inserted/guided into the paired upper surface grooves 203 respectively, the paired cam bosses 107 of the male housing 100 pass through the paired side surface grooves 207, and the paired upper rib 105 and lower rib 106 of the male housing 100 are contacted/guided to the paired upper edge surface 205 and lower edge surface 206 respectively.

At predetermined positions on the rear sides of the two side surfaces of the main body peripheral wall part 201, there are formed a pair of rotation shafts 208 which respectively project outward in the width direction. To the paired rotation shafts 208, there are fitted a pair of holes 303 of the lever (connecting parts between the lever 300 and female housing 200). Thus, the lever 300 is mounted on the female housing 200 in such a manner that it can rotate about the paired rotation shafts 208.

Figure 4A:
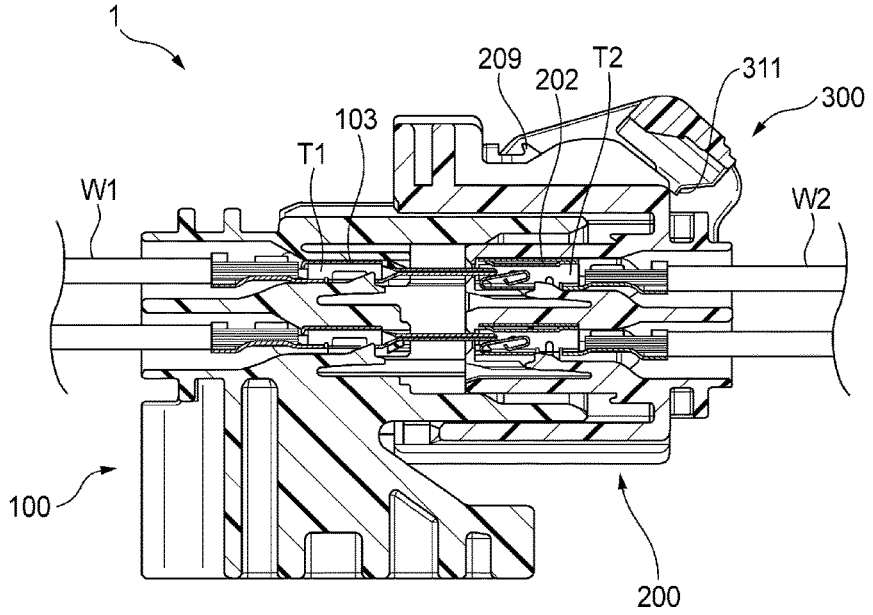
FIG. 4A is a section view taken along the arrow A-A shown in FIG. 3.

In the width-direction central portion of the upper surface of the main body peripheral wall part 201, there is formed an upward projecting lock beak 209 (see FIG. 4A as well). The lock beak 209 is provided so as to hold the lever 300, which simply exists in its final lock position, in the final lock position (the details of which are discussed later).

The main body peripheral wall part 201 includes, in the front side areas of the two side surfaces thereof, guide inclined surfaces 210 which are respectively inclined downward from the lower edge surface 206 of the window 204 and inward in the width direction (see FIGS. 4A to 6C). The function and the like of the guide inclined surface 210 are described later.

As shown in FIG. 2A, the lever 300 is made of resin and has a substantially U-like shape including a pair of side plate parts 301 and a connecting part 302 for connecting together one-side ends of the paired side plate parts 301. In the paired side plate parts 301, there are formed a pair of holes 303 constituted of penetration holes. As the paired rotation shafts 208 of the female housing 200 are inserted into the paired holes 303 respectively, the lever 300 can rotate with respect to the female housing 200 (about the paired rotation shafts 208) in a state where the paired side plate parts 301 sandwich the two side surfaces of the female housing 200.

In the vicinity of the other ends (free ends) of the paired side plate parts 301, there are respectively formed lever side locking parts 304 integrally therewith which project inward in the width direction. As shown in FIGS. 2A and 2B, in a state where the lever 300 is in its temporary lock position, the paired lever side locking parts 304 advance into the paired windows 204 respectively and are locked in such a manner that they are sandwiched by the upper edge surface 205 and lower edge surface 206. Due to such locking of the lever side locking parts 304, the lever 300 is locked at its temporary lock position and is prohibited from moving to the final lock position.

Each lever side locking part 304 includes a projecting section 305 which projects inward in the width direction. In the fitting time, the paired projecting sections 305 are pressed by the front end 106*a* (see FIG. 1B) of the lower rib 106 situated in the vicinity of the paired cam bosses 107 of the male housing 100 to rise onto the top of the lower rib 106, whereby the paired lever side locking parts 304 are elastically deformed outward in the width direction (see the arrow shown in FIG. 6B). As a result, the locking of the lever side locking parts 304 by the lower edge surface 206 is removed, thereby enabling the lever 300 to move forward in the rotation direction from the temporary lock position toward the final lock position.

Figure 4B:
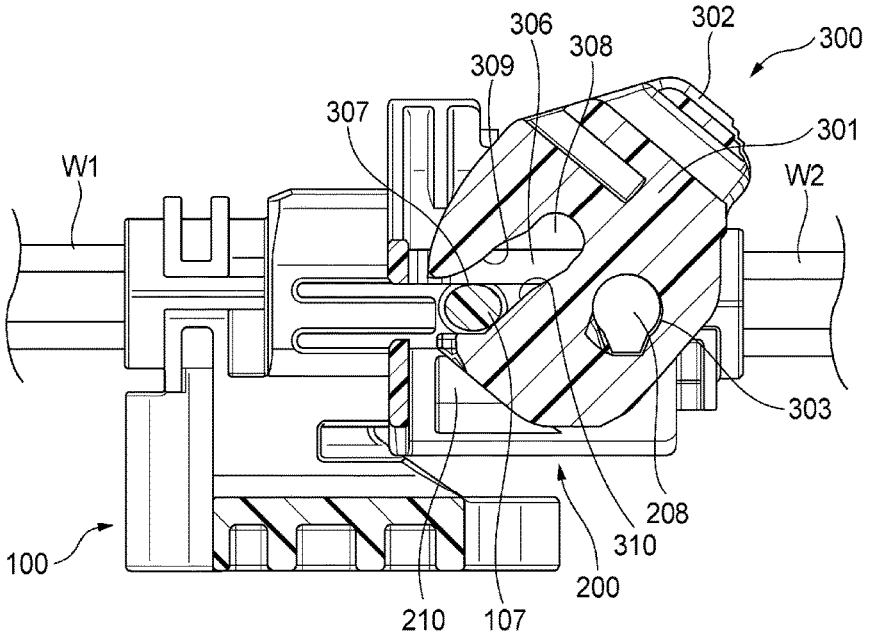
FIG. 4B is a section view taken along the arrow B-B shown in FIG. 3.

In the width-direction inside surfaces of the paired side plate parts 301, there are formed a pair of cam grooves 306 respectively (see, for example, FIG. 4B). The paired cam grooves 306 are formed so as to pull the paired cam bosses 107 of the male housing 100 from the entrance parts 307 of the cam grooves 306 to the innermost parts 308 thereof as the lever 300 rotates from the temporary lock position to the final lock position (the details of which are described later). Here, each cam groove 306 is defined by a side wall 309 existing forward in the rotation direction and a side wall 310 continuous with the side wall 309 and existing rearward in the rotation direction.

In the width-direction central portion of the rotation-direction front end of the connecting part 302 of the lever 300, there is formed a lock beak holding section 311 (see FIGS. 2A and 4A). The lock beak holding section 311 cooperates with the lock beak 209 (see FIGS. 2A and 4A) of the female housing 200 to hold the lever 300, which simply exists at the final lock position, at the final lock position.

Specifically, when the lever 300 reaches the final lock position from the temporary lock position, the lock beak holding section 311 comes into contact with the lock beak 209 to hold it. As a result, the lever 300 simply existing at the final lock position is held at the final lock position. On the other hand, in this state, when the holding of the lock beak 29 by the lock beak holding section 311 is removed, the lever 300 is enabled to move from the final lock position toward the temporary lock position (backward in the rotation direction).

With reference to FIGS. 3 to 7B, description is given below of the operation to fit the male housing 100 into the female housing 200.

Figure 5A:
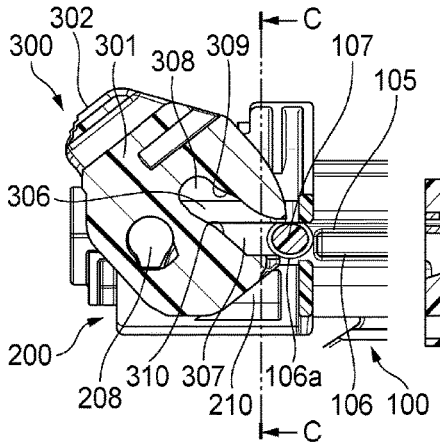
FIGS. 5A and 5B respectively show the position relationships between the cam boss and lever and between male and female terminals in a stage before the fitting start state between the male and female housings.
Figure 5B:
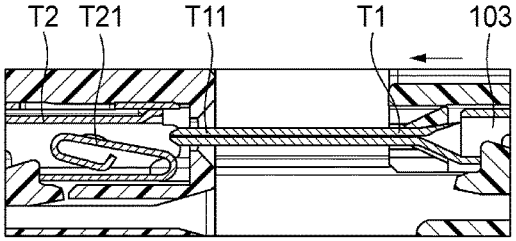

Firstly, with the lever 300 locked at the temporary lock position, the front surfaces of the female housing 200 and male housing 100 are arranged to face each other and, as shown in FIGS. 5A and 5B, the male housing 100 is inserted into the female housing 200. FIGS. 5A and 5B show a stage before the fitting is started.

Figure 6A:
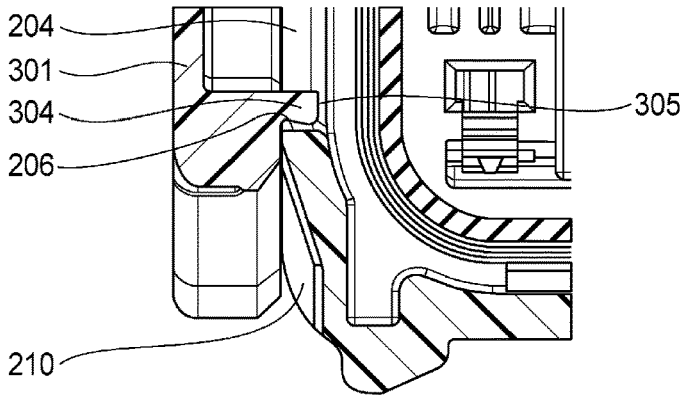
FIG. 6A is a section view taken along the arrow C-C shown in FIG. 5A.

In the stage shown in FIGS. 5A and 5B, the projecting sections 305 of the paired lever side locking parts 304 of the lever 300 are not yet pressed by the front ends 106*a* (see FIG. 1B) of the paired lower ribs 106 of the male housing 100. Therefore, as shown in FIG. 6A, the paired lever side locking parts 304 (the lower surfaces thereof) are locked to the lower edge surfaces 206 of the paired windows 204, thereby prohibiting the lever 300 from moving to the final lock position. Also, in this stage, as shown in FIG. 5B, the leading end T11 of the male terminal T1 is not yet pressed into contact with the elastically deforming part T21 of the female terminal T2.

Figure 3:
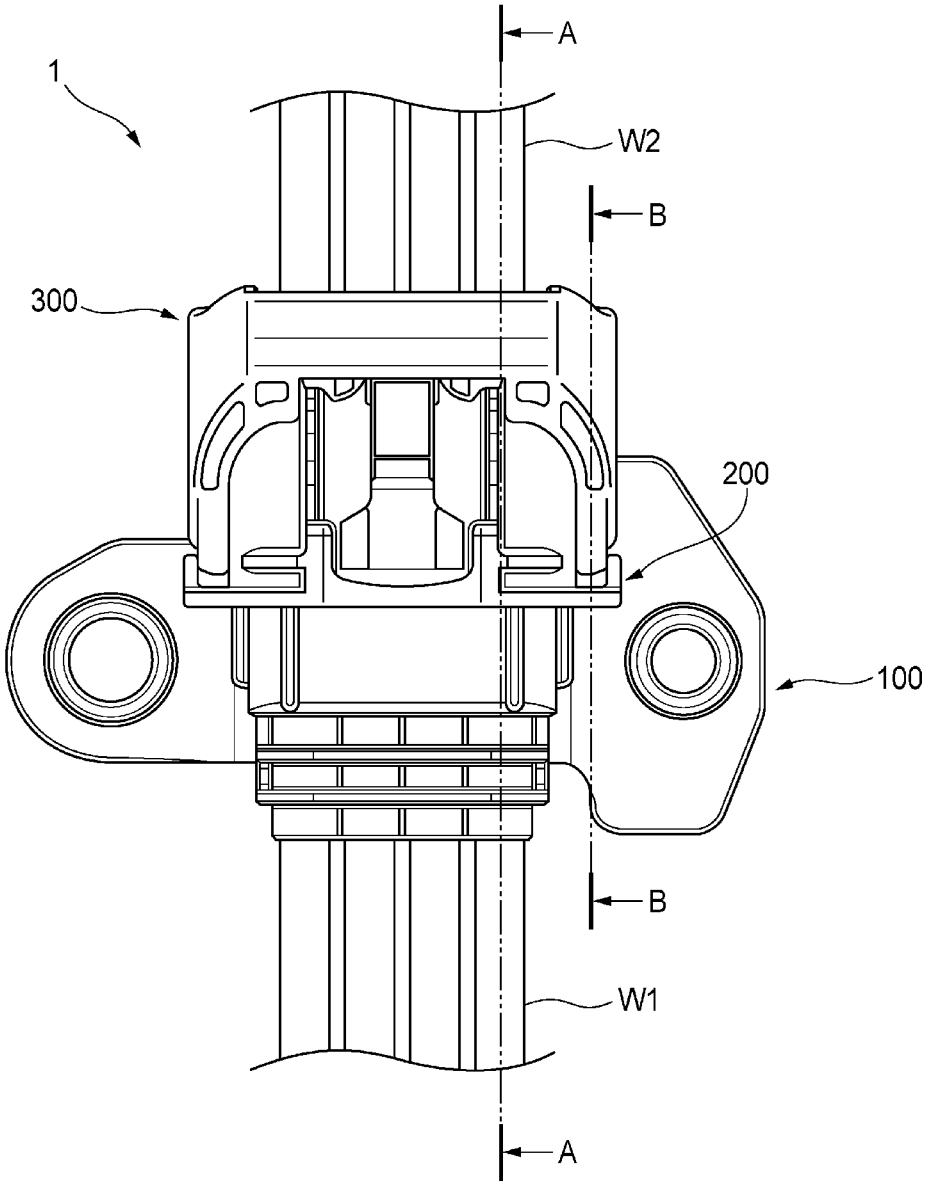
FIG. 3 is a plan view of a fitting start state between the male and female housings.
Figure 5C:
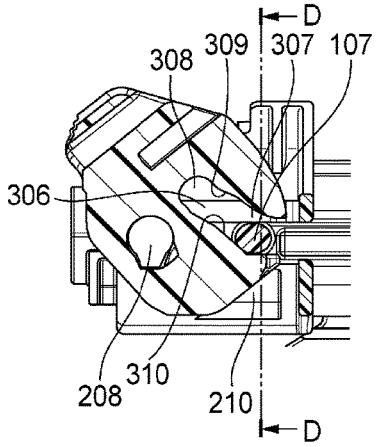
FIGS. 5C and 5D respectively show the position relationships between the cam boss and lever and between male and female terminals in a fitting start state between the male and female housings.
Figure 5D:
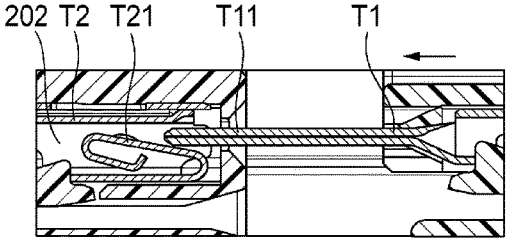

Next, as shown in FIGS. 5C and 5D, the male housing 100 is pressed further in the fitting direction with respect to the female housing 200 and is thereby inserted into a fitting start state (see FIG. 3 and FIGS. 4A and 4B as well). In the fitting start state, as shown in FIG. 5C, the paired cam bosses 107 of the male housing 100 are situated in the entrance parts 307 of the paired cam grooves 306 of the lever 300 and are starting to come into contact with the side walls 310 of the cam grooves 306.

Figure 6B:
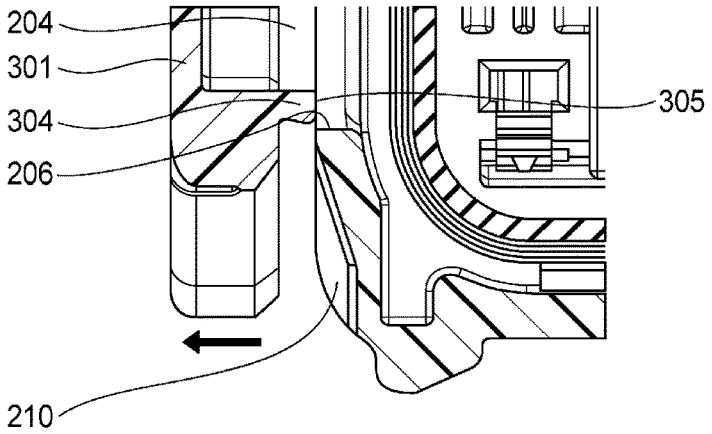
FIG. 6B is a section view taken along the arrow D-D shown in FIG. 5C.
Figure 7A:
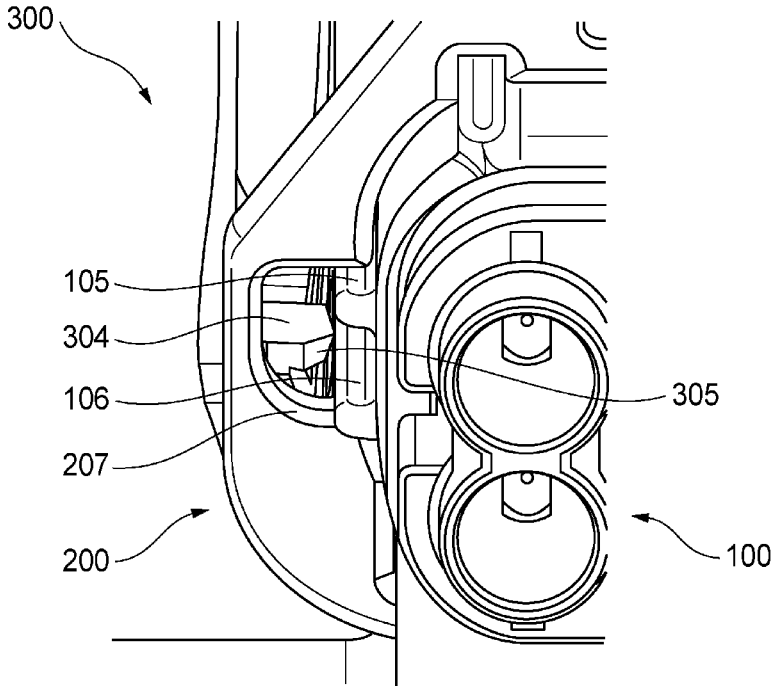
FIG. 7A is a perspective view of the state shown in FIG. 6B when viewed from the male housing side.
Figure 7B:
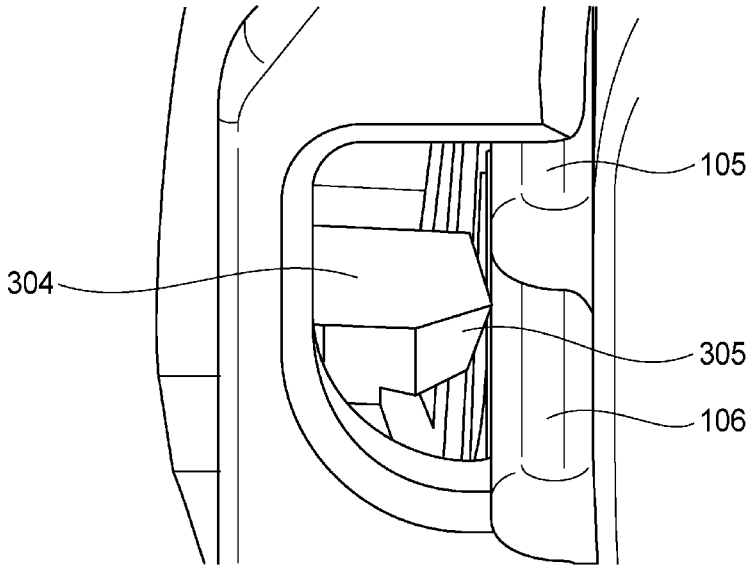
FIG. 7B is an enlarged perspective view of the periphery of a lever side locking part shown in FIG. 7A.

In the fitting start state, as shown in FIGS. 7A and 7B, since the projecting sections 305 of the paired lever side locking parts 304 are pressed by the front ends 106*a* of the paired lower ribs 106 to move onto the top parts of the paired lower ribs 106, as shown in FIG. 6B, the paired lever side locking parts 304 are elastically deformed outward in the width direction (see the arrow shown in FIG. 6B). Thus, the locking of the lever side locking parts 304 by the lower edge surfaces 206 is removed, thereby enabling the lever 300 to move from the temporary lock position to the final lock position. Here, as shown in FIG. 7B, since the projecting sections 305 of the paired lever side locking parts 304 slide on the top parts of the paired lower side ribs 106 in point contact therewith, its frictional force is small when compared with the case of surface contact, thereby enabling suppression of an increase (caused by the sliding motion) in the pressing force of the male housing 100 with respect to the female housing 200.

Also, in the fitting start state, as shown in FIG. 5D, the leading end T11 of the male terminal T1 is not yet pressed into contact with the elastic deformation part T21 of the female terminal T2. In other words, the cam boss 107 comes into contact with the side wall 310 of the cam groove 306 before the leading end T11 of the male terminal T1 is pressed into contact with the elastic deformation part T21 of the female terminal T2. This is because, when the shape of the section of the cam boss 107 is an elliptical shape the major diameter of which extends in the fitting direction, the contact timing of the cam boss 107 with the side wall 310 of the cam groove 306 is earlier than when the shape of the section of the cam boss 107 is a circular shape.

In the fitting start state, as described above, the lever 300 is in a state to be able to move from the temporary lock positon to the final lock position. Therefore, in the fitting start state, when the male housing 100 is pressed further in the fitting direction with respect to the female housing 200, the cam boss 107 presses the side wall 310 of the cam groove 306, whereby the lever 300 starts to rotate from the temporary lock positon toward the final lock position.

Here, in a configuration where, in the fitting start state, the projecting section 305 of the lever side locking part 304 comes into contact with such portion of the top surface of the lower rib 106 as is inclined downward and inward in the width direction, when the elastically deformed projecting section 305 of the lever side locking part 304 presses (the inclined portion of) the top surface of the lower rib 106, the projecting section 305 receives a downward reaction force. On receiving this reaction force, the lever 300 starts to rotate from the temporary lock positon toward the final lock position. In this case, the male housing 100 need not be pressed in the fitting direction with respect to the female housing 200 in order to start the rotation of the lever 300 from the temporary lock positon toward the final lock position.

Figure 5E:
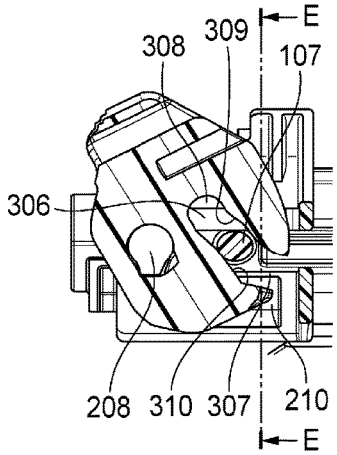
FIGS. 5E and 5F respectively show the position relationships between the cam boss and lever and between male and female terminals in a stage after the fitting start state between the male and female housings.
Figure 5F:
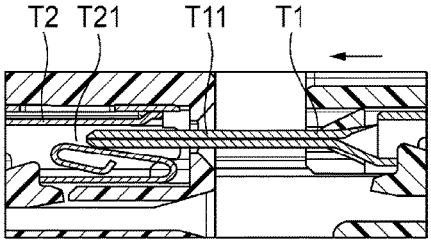
Figure 6C:
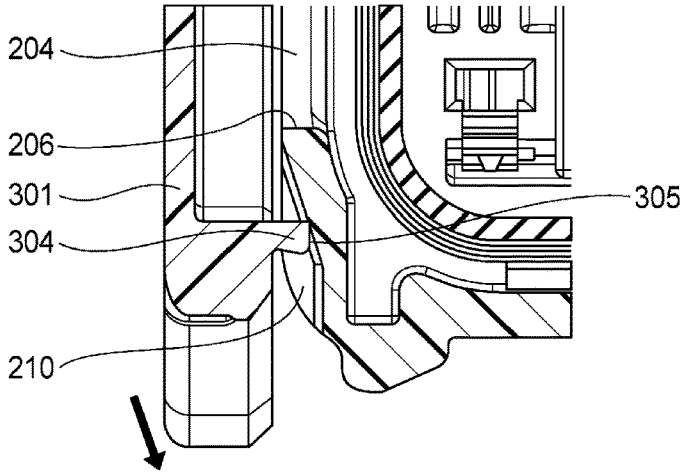
FIG. 6C is a section view taken along the arrow E-E shown in FIG. 5E.

When the rotation of the lever 300 from the temporary lock positon toward the final lock position is started in this manner, as shown in FIGS. 5E, 5F and 6C, the elastically deformed projecting sections 305 of the paired lever side locking parts 304 move onto the paired guide inclined surface 210 of the female housing 200 (see FIGS. 4B to 6C as well) and press the guide inclined surface 210 while recovering elasticity.

Here, as described above, the guide inclined surfaces 210 are inclined downward and inward in the width direction. Therefore, when the elastically deformed projecting sections 305 of the paired lever side locking parts 304 press the guide inclined surface 210 while recovering elasticity, the projecting sections 305 receive a downward reaction force. On receiving this reaction force, the lever 300 receives a force going forward in the rotation direction (toward the final lock position). In other words, just after removal of the locking by the lower edge surfaces 206 of the lever side locking parts 304, there is obtained an assist effect on the rotation of the lever 300 by the guide inclined surface 210. This rotation assist effect enhances the operation feeling just after the lever 300 starts to rotate from the temporary lock positon toward the final lock position.

After the lever 300 starts to rotate from the temporary lock positon toward the final lock position, the lever 300 is rotated toward the final lock position while receiving the rotation assist effect. Thus, since the side walls 309 of the cam grooves 306 press the cam bosses 107 toward the back side of the female housing 200, in accordance with the progress of the rotation of the lever 300, the cam bosses 107 (and eventually the male housing 100) are pulled toward the rear of the female housing 200 (see FIG. 5E).

With the progress of the rotation of the lever 300, the projecting sections 305 of the paired lever side locking parts 304 slide on the guide inclined surfaces 210. In this case, as shown in FIG. 6C, the projecting sections 305 slide on the guide inclined surfaces 210 in point contact therewith. Therefore, a frictional resistance force is small when compared with surface contact, an increase caused by sliding motion in the pressing force of the male housing 100 with respect to the female housing 200 can be suppressed.

The above rotation assist effect decreases gradually as the amount of the elastic deformation of the lever side locking parts 304 decreases with the progress of the rotation of the lever 300 forward in the rotation direction. In this embodiment, as shown in FIGS. 5E and 6C, around the time when the rotation of the lever 300 forward in the rotation direction progresses and the lever side locking parts 304 recover elasticity completely (that is, around the time when the rotation assist effect disappears), as shown in FIG. 5F, the leading end T11 of the male terminal T1 is pressed into contact with the elastic deformation part T21 of the female terminal T2.

Even after the leading end T11 of the male terminal T1 is pressed into contact with the elastic deformation part T21 of the female terminal T2, when the lever 300 is rotated further toward the final locking position, the side walls 309 of the cam grooves 306 press further the cam bosses 107 toward the rear of the female housing 200, whereby, in accordance with the progress of the rotation of the lever 300, the cam bosses 107 (and eventually the male housing 100) are pulled further toward the rear of the female housing 200.

And, when the lever 300 reaches the final lock position, the cam bosses 107 reach the deep-most parts of the cam grooves 306 (see FIGS. 4A to 5F), the male housing 100 is brought into a fitting completion state and, as described above, the lock beak holding part 311 of the lever 300 (see FIG. 4A) is contacted with the lock beak 209 of the female housing 200 (see FIG. 4A) to hold it. This completes conduction connection between the male terminal T1 and female terminal T2 respectively provided in the male housing 100 and female housing 200 (see FIG. 4A), and the lever 300 is held at the final lock position.

Figure 8:
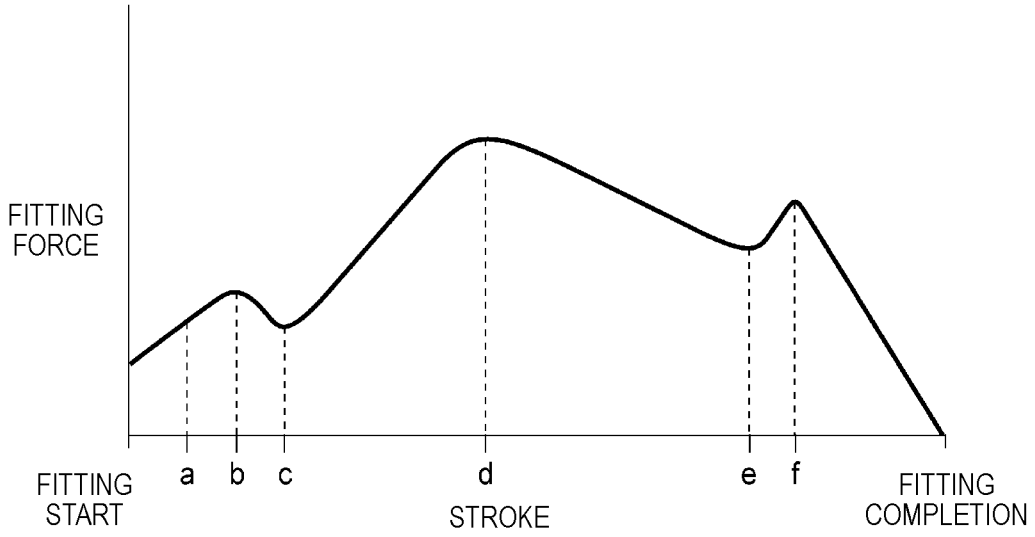
FIG. 8 is a graph of an example of the transition of a fitting force from the start of the fitting to the completion of the fitting between the male and female housings.

Referring to FIG. 8, additional description is given below of an example of the relationship between the amount of the movement (which is hereinafter called [stroke]) of the male housing 100 in the fitting direction from a state where the positions of the front surfaces of the male housing 100 and female housing 200 coincide with each other, and the pressing force (fitting force) required to move the male housing 100 in the fitting direction with respect to the female housing 200.

In FIG. 8, a stroke a corresponds to a timing when the projecting sections 305 of the lever side locking parts 304 are started to be pressed by the front ends 106*a* (see FIG. 1B) of the lower ribs 106 of the male housing 100 (that is, when the lever side locking parts 304 start to deform elastically). A stroke b corresponds to the above-mentioned fitting start state (a state where the amount of the elastic deformation of the lever side locking parts 304 increases to remove the locking by the lower edge surfaces 206 of the lever side locking parts 304, and the cam bosses 107 start to come into contact with the cam grooves 306). A stroke c corresponds to a timing when the lever side locking parts 304 recover elasticity completely and the leading ends T11 of the male terminal T1 are pressed into contact with the elastic deformation parts T21 of the female terminal T2. A stroke d corresponds to a timing when the amount of the elastic deformation of the elastic deformation parts T2 of the female terminal T2 caused by the pressure insertion of the leading ends of the male terminal T1 is maximized. A stroke e corresponds to a timing when the holding operation of the lock beak 209 by the lock beak holding part 311 is started. A stroke f corresponds to a timing when the holding operation of the lock beak 209 by the lock beak holding part 311 is completed (that is, the above-mentioned fitting completion state).

As shown in FIG. 8, even before the stroke a, the pressing force changes so as to increase gradually due to a frictional force produced while the two housings are sliding (a frictional force produced while the main body peripheral parts 101 and 201 are sliding), or the like. From the stroke a to the stroke b, the pressing force increases because a reaction force going inward in the width direction received by the male housing 100 increases according to an increase in the elastic deformation amount of the lever side locking part 304. From the stroke b to the stroke c, the pressing force decreases due to the above-mentioned rotation assist effect. From the stroke c to the stroke d, the pressing force increases because a press-fitting resistance increases according to an increase in the elastic deformation amount of the elastic deformation part T21 of the female terminal T2 when the leading end T11 of the male terminal T1 is press fitted. From the stroke d to stroke e, the pressing force decreases because the sliding resistance between the cam boss 107 and cam groove 306 decreases due to the shape of the cam groove 306 or the like. And, from the stroke e to the stroke f, the pressing force increases because a resistance force caused by the holding operation of the lock beak 209 by the lock beak holding part 311 increases.

As described above, according to the lever-type connector 1 according to the embodiment of the invention, before the fitting is started, the lever side locking part 304 is locked to the lower edge surface 206 of the window 204 of the female housing 200. In the fitting, when the lever side locking part 304 is pressed by the front end 106*a* of the lower rib 106 of the male housing 100 and is removed from the locking, the lever side locking part 304 is quickly guided to the guide inclined surface 210 adjacent to the lower edge surface 206 of the window 204 of the female housing 200. And, when the lever side locking part 304 recovers its elasticity and presses the guide inclined surface 210, due to the reaction force thereof, the lever 300 rotates toward the final lock position (fitting completion position).

Thus, just after removal of the locking of the lever side locking part 304, there is provided a rotation assist effect on the lever 300 by the guide inclined surface 210. This rotation assist effect enhances the operation feeling of the lever 300 just after the lever 300 starts to rotate from the temporary lock position (fitting start position) toward the final lock position (fitting completion position).

Also, the projecting section 305 of the lever side locking part 304 comes into point contact with the guide inclined surface 210. As a result, a frictional resistance force produced between them can be reduced and thus the above-mentioned movement assist effect provided by the guide inclined surface 210 can be enhanced further.

Further, the front end 106*a* of the lower rib 106 of the male housing 100 is arranged in the vicinity of the cam boss 107, and the lever side locking part 304 is arranged in the vicinity of the entrance part 307 of the cam groove 306. Thus, at the timing when the cam boss 107 enters the entrance part 307 of the cam groove 306 (that is, when the cam boss starts its contact with the cam groove 306), the locking of the lever side locking part 304 is removed, whereby the movement of the cam boss 107 along the cam groove 306 (that is, the movement of the lever 300) can be started smoothly. This can enhance the lever 300 operation feeling by an operator still further.

Other Embodiments

Here, the invention is not limited to the above embodiment but various modifications, improvements and the like can be employed properly within the scope of the invention. Also, the materials, shapes, dimensions, number, arrangement locations etc. of the respective composing elements of the above embodiment are arbitrary but not limitative so long as they can attain the invention.

For example, in the above embodiment, the projecting section 305 of the lock beak holding part 311 of the lever 300 slides on the guide inclined surface 210 of the female housing 200 in point contact therewith (see FIG. 6C). However, the shape thereof may also be designed such that it slides on the guide inclined surface 210 of the female housing 200 in line contact therewith. This shape design can also reduce the frictional resistance force when compared with the surface contact sliding, and as a result, it is possible to suppress such an increase in the pressing force of the male housing 100 with respect to the female housing 200 as is caused by the sliding.

Here, the characteristics of the embodiment of the lever-type connector 1 according to the invention are briefly listed in the following configurations (1) to (3).

(1) A lever-type connector (1) comprising:

a first housing (100) and a second housing (200) which are capable of being fitted to each other; and a lever (300) mounted on the second housing (200) and which is movable from a fitting start position to a fitting completion position, wherein the first housing (100) includes a pressing part (106*a*), wherein the second housing (200) includes a housing side locking part (206) and a guide inclined surface (210) which is adjacent to the housing side locking part (206), wherein the lever (300) includes a lever side locking part (304), wherein the lever side locking part (304) is elastically deformable in a first direction and locked to the housing side locking part (205, 206) when the lever (300) is located on the fitting start position, wherein the pressing part (106*a*) moves in a fitting direction together with the first housing (100) and presses the lever side locking part (304) in the first direction into elastic deformation so as to release locking between the lever side locking part (304) and the housing side locking part (206), wherein the guide inclined surface (210) receives the lever side locking part (304) when the lever side locking part is pressed by the pressing part (106*a*) and is unlocked from the housing side locking part (206), and the guide inclined surface (210) has an inclination so as to move the lever (300) toward the fitting completion position when the lever side locking part (304) recovers elasticity and presses the guide inclined surface (210).

(2) The lever-type connector according to the above (1) configuration, wherein the lever side locking part (304) includes a projecting section (305) projecting so as to be point-contact or line-contact with the guide inclined surface (210).

(3) The lever-type connector according to the above (1) or (2) configuration, wherein the first housing (100) includes a cam boss (107) which moves together with the first housing (100) in the fitting direction when the first housing (100) and the second housing (200) are fitted to each other, wherein the lever (300) includes a cam groove (306) capable of receiving the cam boss (107), wherein the lever (300) moves from the fitting start position to the fitting completion position while moving the cam boss (107) along the cam groove (306), wherein the pressing part (106*a*) is formed in a vicinity of the cam boss (107), and wherein the lever side locking part (304) is formed in a vicinity of an entrance part (307) of the cam groove in which the cam boss (107) enters.

DESCRIPTION OF REFERENCE NUMERALS AND SIGNS

1: Lever-type connector
100: Male housing (first housing)
106*a*: Front end (pressing part) of lower rib 106
107: Cam boss
200: Female housing (second housing)
206: Lower edge surface of window (housing side locking part)
210: Guide inclined surface
300: Lever
304: Lever side locking part
305: Projecting section
306: Cam groove
307: Entrance part

What is claimed is:

1. A lever-type connector comprising:

a first housing and a second housing which are capable of being fitted to each other; and a lever mounted on the second housing and which is movable from a fitting start position to a fitting completion position, wherein the first housing includes a pressing part, wherein the second housing includes a housing side locking part and a guide inclined surface which is adjacent to the housing side locking part, wherein the lever includes a lever side locking part, wherein the lever side locking part is elastically deformable in a first direction and locked to the housing side locking part when the lever is located on the fitting start position, wherein the pressing part moves in a fitting direction together with the first housing and presses the lever side locking part in the first direction into elastic deformation so as to release locking between the lever side locking part and the housing side locking part, wherein the guide inclined surface receives the lever side locking part when the lever side locking part is pressed by the pressing part and is unlocked from the housing side locking part, and the guide inclined surface has an inclination so as to move the lever toward the fitting completion position when the lever side locking part recovers elasticity and presses the guide inclined surface.

2. The lever-type connector according to claim 1, wherein the lever side locking part includes a projecting section projecting so as to be point-contact or line-contact with the guide inclined surface.

3. The lever-type connector according to claim 1, wherein the first housing includes a cam boss which moves together with the first housing in the fitting direction when the first housing and the second housing are fitted to each other, wherein the lever includes a cam groove capable of receiving the cam boss, wherein the lever moves from the fitting start position to the fitting completion position while moving the cam boss along the cam groove, wherein the pressing part is formed in a vicinity of the cam boss, and wherein the lever side locking part is formed in a vicinity of an entrance part of the cam groove in which the cam boss enters.

* * * * *